United States Patent [19]

Natzke et al.

[11] Patent Number: 4,779,481

[45] Date of Patent: Oct. 25, 1988

[54] ADJUSTABLE TWO-PEDAL SWING CONTROL APPARATUS

[75] Inventors: Ronald C. Natzke, Burlington; Richard H. Logan, West Burlington, both of Iowa

[73] Assignee: J. I. Case Company, Racine, Wis.

[21] Appl. No.: 39,322

[22] Filed: Apr. 16, 1987

[51] Int. Cl.[4] ..... G05G 1/14

[52] U.S. Cl. ..... 74/512; 74/560; 74/474; 280/231

[58] Field of Search ..... 74/560, 474, 547, 564, 74/594.4, 594.6, 594.5, 594.7, 561, 512; 280/291, 292

[56] References Cited

U.S. PATENT DOCUMENTS

| | | | |
|---|---|---|---|
| 3,765,265 | 10/1973 | Dzus | 74/560 |
| 3,773,355 | 11/1973 | Swartz | 280/291 |
| 3,794,353 | 2/1974 | Oliver | 280/291 |
| 3,853,020 | 12/1974 | Clark | 74/474 |
| 3,919,896 | 11/1975 | Foster | 74/560 |
| 3,943,795 | 3/1976 | Kenney | 74/560 |
| 4,030,561 | 6/1977 | Hashimoto et al. | 74/594.7 |
| 4,083,263 | 4/1978 | Lundquist | 74/512 |
| 4,225,130 | 9/1980 | Zimmerman | 74/594.4 |
| 4,401,315 | 8/1983 | Pavincic | 280/291 |
| 4,456,090 | 6/1984 | Malenotti | 280/291 |
| 4,470,321 | 9/1984 | Girty | 74/474 |
| 4,546,993 | 10/1985 | Walker | 280/291 |
| 4,591,179 | 5/1986 | Nakamura | 280/291 |

FOREIGN PATENT DOCUMENTS

| | | | |
|---|---|---|---|
| 152673 | 10/1903 | Fed. Rep. of Germany | 280/291 |
| 863005 | 11/1952 | Fed. Rep. of Germany | 280/291 |
| 372260 | 5/1932 | United Kingdom | 280/291 |

*Primary Examiner*—Richard E. Moore
*Assistant Examiner*—Vinh Luong
*Attorney, Agent, or Firm*—Peter N. Jansson, Ltd.

[57] ABSTRACT

An adjustable two-pedal swing control apparatus for tractor backhoe booms and the like. The apparatus has a pivot shaft member pivotably mounted with respect to a tractor upright, a shaft-engaging structure on the pedal engaged with an end portion of the pivot shaft, such end portion and shaft-engaging structure being dimensioned and arranged to allow a degree of rotation of the pedal with respect to the pivot shaft, a pair of aligned projecting members from the pivot shaft and shaft-engaging structure, and a threaded adjustment therebetween to set the position of the rotational range of the pedal.

20 Claims, 2 Drawing Sheets

ADJUSTABLE TWO-PEDAL SWING CONTROL APPARATUS

FIELD OF THE INVENTION

This invention is related generally to swing control mechanisms for tractor booms and the like and, more particularly, to two-pedal swing control mechanisms.

BACKGROUND OF THE INVENTION

The swing mechanisms for tractor booms, such as backhoe booms, are controlled by valves or switch means which, in some cases, are actuated by a pair of foot-operated pedals. Such pedals are typically on either side of a vertical housing structure which contains various control rods and linkages related to various boom and tool movements.

The pedals are each pivotably mounted with respect to a tractor upright, which is usually part of the vertical structure. Control linkages typically extend from a shaft affixed to a pedal toward the appropriate valve or switch which swings the boom to the right or to the left.

The operator usually sits on a seat facing and somewhat straddling such vertical structure with one foot on each of the two pedals. Depressing the right pedal causes the boom to swing to the right, while depressing the left pedal causes the boom to swing to the left. Various mechanical linkages typically cause the pedal not being depressed to move upward while the other pedal is depressed.

Since operators of different sizes and physical characteristics operate the equipment, the orientation or position of the foot pedals with respect to the seat frequently is improper for the person operating the equipment. For example, a short operator may have difficulty properly engaging both pedals with his feet unless he slides forward on the seat. Even then, the angle of the pedals may not be comfortable for him. Long-legged operators have the same sorts of problems related to ease of use and comfort during use.

Furthermore, any operator using the equipment over a long work shift may find it uncomfortable to maintain his legs, feet and other parts of his body. in the same orientation hour after hour. Periodic adjustment is considered desirable over such long periods of time.

In the past, tractor boom swing control pedals have been adjusted by adjusting the length of control rods which are typically inside the vertical structure. Such adjustments may be difficult because of the relative inaccessibility of such control rods and sometimes because of the nature of the control rod interconnections. Other adjustment concepts, such a placing blocks on the pedals, are considered undesirable since they tend to make operation of the swing control pedals more difficult.

There has been a need for an improved two-pedal swing control apparatus which may readily be adjusted to position the pedals to accommodate different operators, and to change the body and leg orientations of an operator from time to time.

OBJECTS OF THE INVENTION

It is an object of this invention to provide an improved tractor swing control mechanism overcoming some of the problems and shortcomings of the prior art.

Another object of this invention is to provide an improved two-pedal swing control apparatus which may be easily and quickly adjusted to accommodate different operators.

Another object of this invention is to provide a two-pedal swing control apparatus which may be adjusted without the need to gain access to control rods and other structures which are not readily accessible, and without the need to use tools.

These and other important objects will be apparent from the descriptions of this invention which follow.

SUMMARY OF THE INVENTION

This invention is an improved swing control apparatus for tractor booms and the like of the type having two pedals, each pivotably mounted with respect to an upright, with control linkages extending from each pedal. The pedals of the improved swing control apparatus may quickly and easily be adjusted by the equipment operator to accommodate his physical characteristics and preferences.

The swing control apparatus of this invention includes, for each pedal, a pivot shaft member pivotably mounted with respect to a tractor upright, a shaft-engaging structure affixed to the pedal and engaged with the pivot shaft member, and pedal adjustment means extending between the pivot shaft member and the shaft-engaging structure. The pivot shaft member has a linkage attachment means, preferably on the side of the upright away from the pedal, from which a control linkage extends toward a control valve or switch. Depression of the pedal rotates the pivot shaft member to cause appropriate movement of such control linkages.

The pivot shaft member also has a pedal-mounting end portion to which the shaft-engaging structure, which is affixed to the pedal, is attached. The pivot shaft end portion and shaft-engaging structure are dimensioned and arranged to allow a degree of rotation of the pedal with respect to the pivot shaft, and adjustment means between the pivot shaft member and the shaft-engaging structure. The pedal adjustment means is a limiting means extending between the pivot shaft member and the shaft-engaging structure to limit the degree of relative rotation, and thereby adjust the position of the pedal.

The shaft-engaging structure affixed to the pedal is itself preferably a shaft (the "pedal shaft") which has an end portion sometimes referred to herein as the pedal shaft end portion. Such pedal shaft end portion and the pedal-mounting end portion of the pivot shaft member are engaged. These two end portions form coaxially mating male and female shaft members.

The female shaft member preferably has a cylindrical hollow portion opening at its end, and the male shaft member is received within such cylindrical opening. The pedal-mounting end portion of the pivot shaft member is preferably the male member, while the pedal shaft is the female shaft member.

The female shaft member preferably has an open-ended axially extending slot of fixed rotational dimension (that is, slot width) and a first projecting member affixed thereto and axially positioned adjacent to the slot. The male shaft member preferably has a radially-extending second projecting member received within and extending through the slot.

Such second projecting member is dimensioned, with respect to the slot width, to allow a degree of rotation of the pedal with respect to the pivot shaft. The adjustment means, or limiting means, extends between such two projecting members, thus setting the spacing between such projecting members. In this way, the limiting means sets the position of the pedal.

The two projecting members are preferably substantially vertically aligned, one being sometimes referred to herein as the upper projecting member while the other is sometimes referred to as the lower projecting member. The first projecting member, that is, the projecting member extending from the female shaft member, is preferably the upper member. Such upper member is preferably biased toward the lower member by the weight of the pedal.

The limiting means includes an opening in one of the projecting members and an elongated member extending adjustably through such opening. Such elongated member has a distal end which bears against the other projecting member and at its opposite end a hand grip adjustment member.

Such opening is preferably in the upper projecting member, with the elongated member secured, most preferably by threaded engagement, to such upper projecting member. In the preferred embodiments including such threaded engagement, the pedal position may be adjusted simply by turning the hand grip, which is preferably in the form of a knob.

The pivot shaft is preferably carried in a mounting sleeve which is secured to the tractor upright about a mounting aperture in such upright. Such mounting sleeve rotationally supports the pivot shaft with its pedal-mounting end portion and its linkage attachment means on opposite sides of the upright.

Many variations are possible in this invention, as will be noted herein in greater detail.

DETAILED DESCRIPTIONS OF PREFERRED EMBODIMENTS

Figure 1:
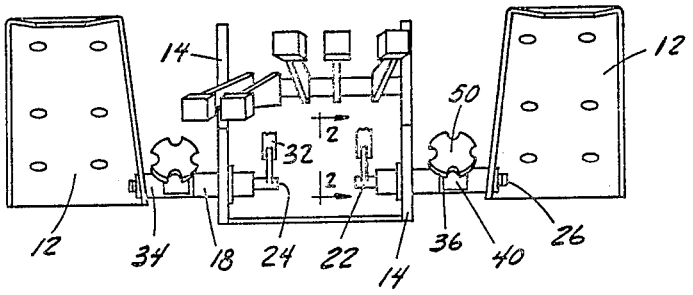
FIG. 1 is a plan view of the control section of a backhoe tractor having the swing control mechanism of this invention, showing a pair of pedals on either side of a control housing.
Figure 2:
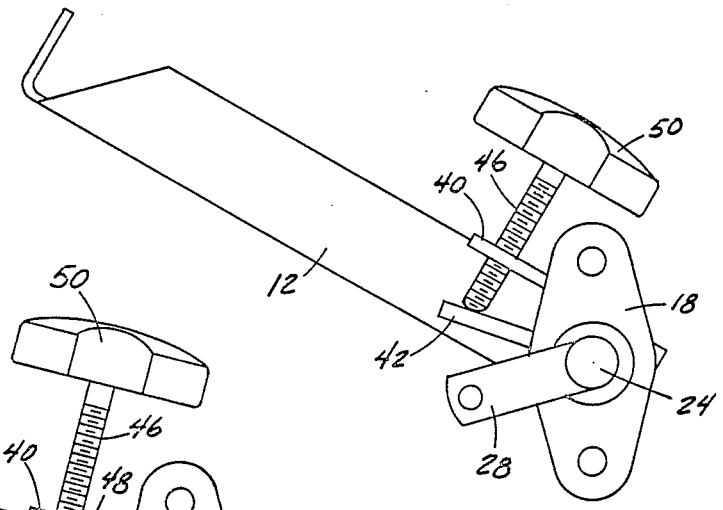
FIG. 2 is an enlarged fragmentary sectional view of FIG. 1, taken along section 2-2 as indicated in FIG. 1, illustrating the pedal adjusted to a raised position.
Figure 4:
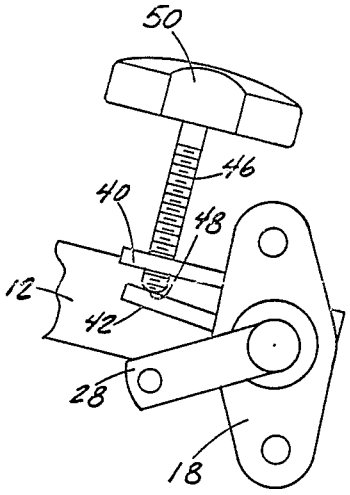
FIG. 4 is another fragmentary side sectional as in FIG. 2, with background removed, illustrating the pedal adjusted to a lower position.
Figure 3:
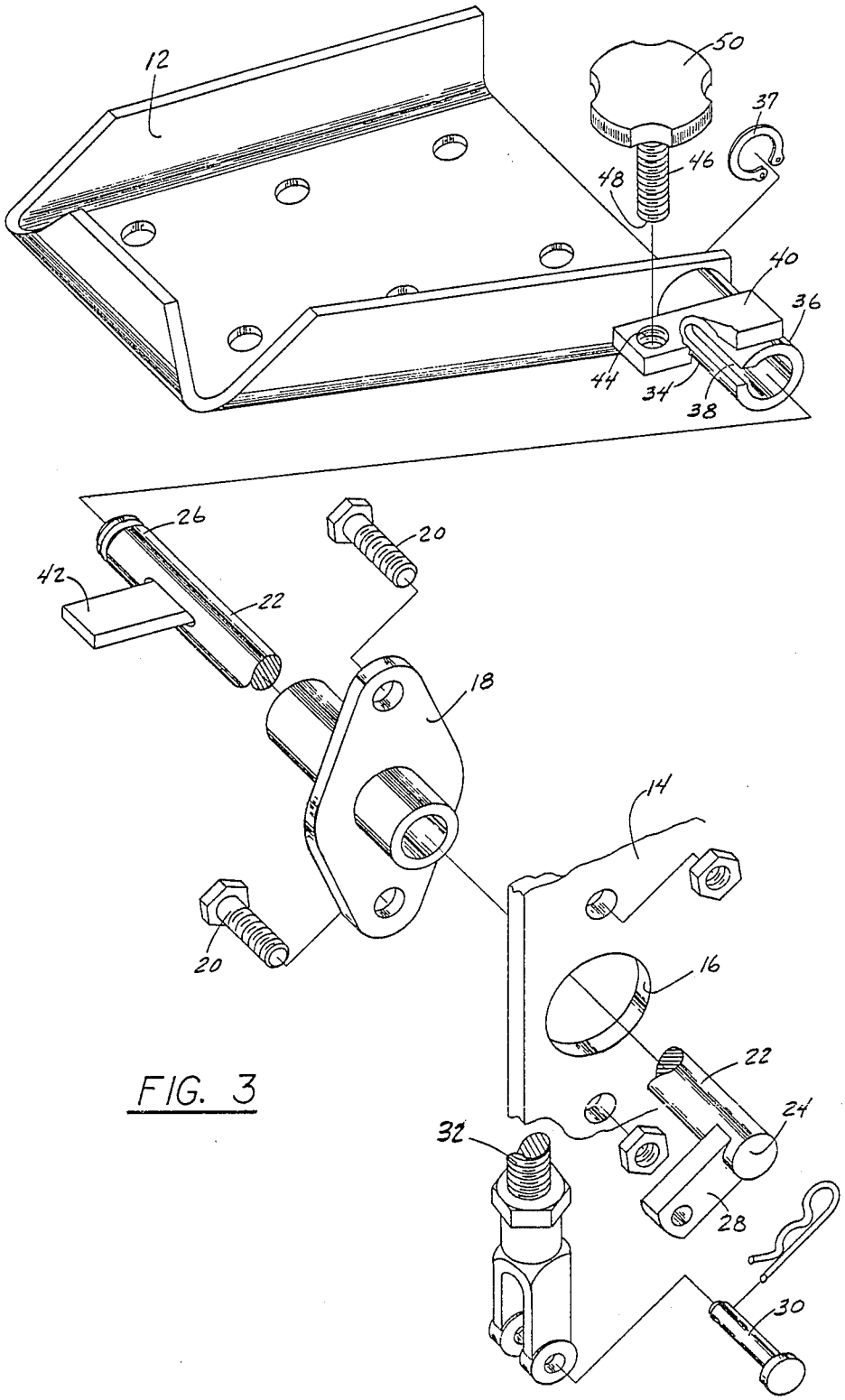
FIG. 3 is an exploded perspective view including the apparatus shown in FIG. 2.

The drawings illustrate a preferred swing control apparatus 10. Each of the two pedals is essentially the mirror image of the other, so detailed descriptions will be made only with respect to one of the pedals. Each swing control mechanism 10 preferably mounts a pedal 12 with respect to an upright 14 of an upright housing structure enclosing tractor control elements.

Upright 14 defines a mounting aperture 16. A mounting sleeve 18 is secured to upright 14 about mounting aperture 16 by bolts 20. Rotatably supported within mounting sleeve 18 is a pivot shaft 22 which extends from an inner end 24 on one side of upright 14 to an outer end, referred to herein as first end portion or pedal-mounting end portion 26, on the other side of mounting sleeve 18. Inner end 24 has a short arm 28, the end of which has a pin 30 which provides means to attach a control rod 32. Control rod 32 extends toward a valve or switch (not shown) which forms no part of this invention.

Pivot shaft 22 turns in sleeve 18 as pedal 12 is depressed or raised. Pedal 12 is attached to pivot shaft 22 by means of a shaft-engaging structure 34, which is part of a pedal shaft 36 affixed to pedal 12. Structure 34 is engaged with end portion 26 of pivot shaft 22, the two parts held in axial position by a ring 37 snapped on shaft 22. Shaft-engaging structure 34 is itself an end portion of pedal shaft 36, and is sometimes referred to as the second end portion 34 or the pedal-shaft end portion 34.

Thus, second end portion 34 of pedal shaft 36 is engaged with first end portion 26 of pivot shaft 22, such end portions forming mating male and female shaft members. In this embodiment second end portion 34 forms the female shaft member, while first end portion 26 forms the male shaft member.

Second end portion 34 has an open-ended axially extending slot 38 which is parallel to the axis of pedal shaft 36 and pivot shaft 22. Slot 38 has a fixed rotational dimension (width) which is constant along its length. Affixed to second end portion 34 and extending tangentially from pedal shaft 36 adjacent to slot 38 is a first projecting member 40. First projecting member 40 is axially positioned adjacent to slot 38.

Pedal-mounting end portion 26 of pivot shaft 22 has a radially extending second projecting member 42. Second projecting member 42 extends from the main portion of pivot shaft 22 through slot 38 and adjacent to first projecting member 40.

Slot 38 and second projecting member 42 are dimensioned to allow a degree of relative rotational movement of pedal shaft 36 with respect to pivot shaft 22. More specifically, the thickness of second projecting member 42 is less than the width of slot 38. Increasing the dimension of slot 38 increases the extent of such relative rotational movement. It is essential that the dimensioning of slot 38 and second projecting member 42 allow enough of such relative rotational movement to provide for appropriat adjustments of the pedal position.

First and second projecting members 40 and 42 are vertically aligned, first projecting member 40 being an upper member and second projecting member 42 being a lower member.

A threaded opening 44 extends through first projecting member 40 and receives a threaded elongated member 46 which is used to limit the range of relative rotational movement of pedal shaft 36 with respect to pivot shaft 22. Threaded elongated member 46 has a distal end 48 which bears against second projecting member 42 and a knob 50 at its opposite end. By turning knob 50 the spacing between the facing surfaces of first and second projecting members 40 and 42 is adjusted.

During operation, pedal 12 will move through a given angle range to swing the backhoe boom or other boom (not shown) from side to side. By turning knob 50 to adjust the spacing of first and second projecting members 40 and 42, the location of the range of motion of pedal 12 is adjusted.

When the spacing between first and second projecting members 40 and 42 is very small or nonexistent, the range of motion of the pedal will be lowest, which typically accommodates an operator having long legs. On the other hand, when the spacing between the first and second projecting members 40 and 42 is greatest, the range position is raised, thus raising the pedal for any given swing position of the boom.

In the illustrated embodiment, in which first projecting member 40 is the upper member, the upper member is biased toward the lower member by virtue of the weight of pedal 12, which is affixed with respect to projecting member 40.

A great number of variations are possible within the scope of this invention. For example, the male and female orientation of the pivot shaft and pedal shaft can be reversed, provided other appropriate adjustments are made. Another possible change would involve reversing the mounting of elongated member 46 such that the knob is below the projecting members, which in some cases may be desirable provided the knob may be easily reached and turned. The structure of the adjustment mean for limiting the relative rotational movement of the pedal shaft with respect to the pivot shaft can be varied significantly. Many other variations are possible and would be apparent to those skilled in the art who are made familiar with this invention.

Swing control mechanism 10 is made primarily of structural steel, as is common for equipment of this sort. Variations of materials, connecting devices, and the like would all be apparent to those skilled in the art who are made familiar with this invention.

While the principles of this invention have been described in connection with specific embodiments, it should be understood clearly that these descriptions are made only by way of example and are not intended to limit the scope of the invention.

What is claimed is:

1. In swing control apparatus of the type with two pedals, each pivotably mounted with respect to an upright, and control linkages extending from each pedal, the improvement comprising:

a pivot shaft member extending pivotably through the upright and having a pedal-mounting end portion;

a shaft-engaging structure on the pedal rotatably engaged with said end portion, the end portion and shaft-engaging structure dimensioned and arranged to allow a degree of rotation of the pedal with respect to the pivot shaft;

a pair of radially projecting means extending from the pivot shaft member and the shaft-engaging structure, respectively; and adjustable limiting means extending between the pair of radially projecting means to limit the degree of relative rotation, thereby allowing easy adjustment of the pedals by operators to position the range of pedal movement in order to accommodate such operators.

2. The swing control apparatus of claim 1 wherein the shaft-engaging structure on the pedal is itself a shaft having a pedal shaft end portion, said two end portions forming coaxially mating male and female shaft members.

3. In swing control apparatus of the type with two pedals each pivotably mounted with respect to an upright and control linkages extending from each pedal, the improvement comprising:

a pivot shaft member pivotably mounted with respect to the upright and having a pivot-shaft end portion;

a pedal shaft having a pedal-shaft end portion rotatably engaging the pivot-shaft end portion, the pivot-shaft end portion and pedal-shaft end portion dimensioned and arranged to allow a degree of rotation of the pedal with respect to the pivot shaft, the two end portions forming coaxially mating male and female shaft members, the female shaft member having an open-ended axially extending slot of fixed rotational dimension;

the female member having a first projecting member axially positioned adjacent to the slot;

the male shaft member having a radially-extending second projecting member extending through the slot and dimensioned to allow said degree of pedal rotation with respect to the pivot shaft; and adjustable limiting means extending between the projecting members to limit the degree of relative rotation of the pedal with respect to the pivot shaft, thereby allowing easy adjustment of the pedals by operators.

4. The swing control apparatus of claim 3 wherein the pivot shaft forms the male shaft member and the pedal shaft end portion forms the female shaft member.

5. The swing control apparatus of claim 3 wherein the projecting members are substantially vertically aligned and are upper and lower projecting members.

6. The swing control apparatus of claim 5 wherein the first projecting member is the upper member, said upper member being biased toward the lower member by the weight of the pedal.

7. The swing control apparatus of claim 5 wherein the limiting means comprises:

an opening in one of the projecting members;

an elongated member extending adjustably through the opening, said elongated member having a distal end bearing against the other projecting member and a hand grip adjustment member at its opposite end.

8. The swing control apparatus of claim 7 wherein the opening is in the upper projecting member and the elongated member is secured to the upper projecting member.

9. The swing control apparatus of claim 7 wherein the opening and the elongated member are in threaded engagement whereby the pedal position may be adjusted by turning the hand grip.

10. The swing control apparatus of claim 9 wherein the threaded engagement of the elongated member is with the upper projecting member.

11. The swing control apparatus of claim 10 wherein the pivot shaft forms the male shaft member and the pedal shaft end portion forms the female shaft member.

12. In a tractor boom swing control mechanism of the type having two pedals each pivotably mounted with respect to a tractor upright and control linkage means extending from each pedal, the improvement for each pedal comprising:

a pivot shaft pivotably mounted with respect to the upright and having a first end portion and a linkage attachment means;

a pedal shaft affixed to the pedal and extending to a second end portion engaged with the first end portion, the end portions forming mating male and female shaft members;

the female shaft member having an open-ended axially extending slot of fixed rotational dimension and a first projecting member axially positioned adjacent to the slot;

the male shaft member having a radial second projecting member within the slot and dimensioned to allow a degree of relative rotational adjustment of the shafts; and rotational adjustment means extending between the projecting members, whereby the position of the operational range of pedal movement can readily be adjusted to position the pedals to accommodate different operators.

13. The swing control apparatus of claim 12 wherein the pivot shaft forms the male shaft member and the pedal shaft forms the female shaft member.

14. The swing control apparatus of claim 12 wherein the projecting members are substantially vertically aligned and are upper and lower projecting members.

15. The swing control apparatus of claim 14 wherein the first projecting member is the upper member, said upper member being biased toward the lower member by the weight of the pedal.

16. The swing control apparatus of claim 14 wherein the limiting means comprises:

an opening in one of the projecting members;

an elongated member extending adjustably through the opening, said elongated member having a distal end bearing against the other projecting member and a hand grip adjustment member at its opposite end.

17. The swing control apparatus of claim 16 wherein the opening is in the upper projecting member and the elongated member is secured to the upper projecting member.

18. The swing control apparatus of claim 16 wherein the opening and the elongated member are in threaded engagement whereby the pedal position may be adjusted by turning the hand grip.

19. The swing control apparatus of claim 18 wherein the threaded engagement of the elongated member is with the upper projecting member.

20. The swing control apparatus of claim 16 further comprising:

a mounting aperture formed in the upright; and a mounting sleeve secured to the upright about the aperture and rotatably supporting the pivot shaft with its first end portion and linkage attachment means on opposit sides of the upright.

* * * * *